US009205624B2

(12) United States Patent
Diehr et al.

(10) Patent No.: US 9,205,624 B2
(45) Date of Patent: Dec. 8, 2015

(54) ROTARY EMBOSSING DEVICE WITH MOUNTING SYSTEM AND ANGULAR ADJUSTMENT

(71) Applicant: HEIDELBERGER DRUCKMASCHINEN AG, Heidelberg (DE)

(72) Inventors: Wolfgang Diehr, Grevenbroich (DE); Tobias Ring, Mannheim (DE); Frank Schmid, Krefeld (DE)

(73) Assignee: Masterwork Machinery Co. Ltd., Tianjin (CN)

( * ) Notice: Subject to any disclaimer, the term of this patent is extended or adjusted under 35 U.S.C. 154(b) by 0 days.

(21) Appl. No.: 14/164,975

(22) Filed: Jan. 27, 2014

(65) Prior Publication Data

US 2014/0208966 A1 Jul. 31, 2014

(30) Foreign Application Priority Data

Jan. 25, 2013 (DE) ..... 10 2013 001 247

(51) Int. Cl.
*B31F 1/07* (2006.01)
*B44B 5/02* (2006.01)

(52) U.S. Cl.
CPC ..... *B31F 1/07* (2013.01); *B31F 2201/073* (2013.01); *B44B 5/026* (2013.01)

(58) Field of Classification Search
CPC ..... B31F 1/07; B31F 2201/073; B31F 2201/0723; B44B 5/026; B41F 27/06; B41F 27/10; B41F 27/12; B41F 27/1218
See application file for complete search history.

(56) References Cited

U.S. PATENT DOCUMENTS

| | | | | |
|---|---|---|---|---|
| 3,264,978 | A * | 8/1966 | Staley | 101/23 |
| 4,003,114 | A * | 1/1977 | Lewicki et al. | 492/1 |
| 4,982,639 | A * | 1/1991 | Kirkpatrick | 83/659 |
| 2009/0031910 | A1 | 2/2009 | Simon | |
| 2011/0011286 | A1 * | 1/2011 | Strasser | 101/23 |
| 2012/0048131 | A1 * | 3/2012 | Diehr et al. | 101/3.1 |

FOREIGN PATENT DOCUMENTS

| | | | |
|---|---|---|---|
| CH | 140737 | A | 6/1930 |
| DE | 3940744 | A1 | 6/1991 |
| DE | 202008017133 | U1 | 3/2009 |
| DE | 102010036011 | A1 | 3/2012 |
| GB | 671431 | A | 5/1952 |

* cited by examiner

*Primary Examiner* — Daniel J Colilla
*Assistant Examiner* — Leo T Hinze
(74) *Attorney, Agent, or Firm* — Laurence A. Greenberg; Werner H. Stemer; Ralph E. Locher

(57) ABSTRACT

A rotary embossing device, in particular for making Braille embossments, includes a drive shaft and at least one embossing tool disposed thereon. The embossing tool includes a roller body, a mounting system and a tool sleeve. The tool sleeve is mounted to the roller body by the mounting system. The mounting system includes at least one mounting ring disposed between the roller body and the tool sleeve. The at least one mounting ring is advantageously engaged with an adjustment device for rotating the at least one mounting ring to adjust the angular position of the tool sleeve. The mounting ring includes at least one elastomeric ring and the mounting system further includes an axially displaceable mounting cover for compressing the at least one elastomeric ring. Tool sleeves can therefore be easily and quickly mounted and adjusted.

13 Claims, 4 Drawing Sheets

ROTARY EMBOSSING DEVICE WITH MOUNTING SYSTEM AND ANGULAR ADJUSTMENT

CROSS-REFERENCE TO RELATED APPLICATION

This application claims the priority, under 35 U.S.C. §119, of German Patent Application DE 10 2013 001 247.3, filed Jan. 25, 2013; the prior application is herewith incorporated by reference in its entirety.

BACKGROUND OF THE INVENTION

Field of the Invention

The invention relates to a rotary embossing device for embossing flat materials such as sheets, blanks, webs of paper, cardboard, plastics and composite materials. The rotary embossing device includes a drive shaft and at least one embossing tool disposed thereon. The embossing tool has a roller body, a mounting system and a tool sleeve. The tool sleeve is mounted to the roller body by the mounting system.

Folding boxes are packages made of cardboard or corrugated board or, to a more limited extent, of plastics. Depending on their construction, glue is applied to one or more locations of such a folding box during the folding process. In general, folding boxes are produced from blanks. The blanks are usually cut out in a flat-bed or rotary die cutter. The blank needs to be folded along multiple lines and to be glued at least along one edge. The folded boxes are flat when they exit the folder-gluer and may be stacked in compact stacks or packaged in cardboard shipping boxes. The folding boxes may be erected and filled manually or automatically in a packing machine.

In addition to the folds required to produce folding boxes, further crease lines are pre-folded in the folder-gluer as a preparation of the following production step. That is done to facilitate the erection and the subsequent filling of the box.

If the folding boxes are used to package pharmaceuticals, it is mandatory for the name of the product to be written, for example embossed, onto the folding box in letters for the blind, also referred to as Braille letters. Such a requirement frequently also applies to blister packs, which also need to be embossed with Braille letters or other types of embossments.

In accordance with the prior art, the Braille letters may be embossed during the die cutting process in the die cutting machine when the blanks are being produced. However, that is a laborious process since a sheet to be cut contains multiple blanks, and for each blank, a pair of tools formed of a male tool and a female tool needs to be provided.

Alternatively, the embossment may be created in a rotary embossing device that includes two rotating embossing tools and may, for instance, be part of a folder-gluer.

Known Braille embossing devices in general are formed of an upper rotary tool, the male braille tool, and a lower rotary tool, the female Braille tool. The male Braille tool has a defined number of raised Braille embossing dots on its embossing side. The female Braille tool in general has the maximum possible number of Braille dot depressions so that it is a universally usable tool. The number of depressions or cells depends on whether the Braille embossment to be applied is based on the common 6-dot system or on the 8-dot system.

A plurality of different Braille embossments is necessary in particular for producing packaging for pharmaceuticals. For that purpose, the male Braille tool needs to be changed for every new job to be produced, requiring a plurality of male Braille tools to be kept in stock in a tool storage room.

German Utility Model DE 20 2008 017 133 U1 discloses leaving the roller bodies unchanged and only changing the tool to reduce storage requirements. The tool is attached to the circumferential surface of the roller body by magnets and is held thereon during operation by magnetic force.

German Patent Application DE 10 2010 036 011 A1, corresponding to U.S. Patent Application Publication No. 2012/0048131, discloses a tool for a rotary embossing device for embossing flat, sheet-shaped material. The device includes two rotating embossing tools in the form of a male tool and a female tool for creating the embossments. At least the male tool is formed of a roller body to which a continuous, annular tool sleeve or a slotted tool sleeve is attached. The tool sleeves are fixed by mounting systems that are described in detail. The male tool sleeve has raised embossment dots on its circumferential outer surface, in accordance with the job to be embossed. Those dots interact with corresponding depressions in the circumferential outer surface of the universal female tool.

The disadvantages of mounting systems of that type include the fact that they have high mass inertial forces, which may result in imbalances, and that they are difficult to access by a machine operator, a fact which makes changing the embossment sleeve a complex and time-consuming process.

A further disadvantage is that when two or more male embossing tools are mounted to the same drive shaft, relative synchronization between the two is impossible. However, for reasons of manufacturing tolerances, such synchronization is necessary to produce high-quality printed products. That is true in particular for meeting the legal requirements for embossing Braille letters for the blind. The prior art only discloses ways to synchronize the male embossing tool and the associated female embossing tool by rotating their drive shafts relative to each other. However, that method only allows both (or several) male embossing tools to be corrected by the same angular degree.

SUMMARY OF THE INVENTION

It is accordingly an object of the invention to provide a rotary embossing device with a mounting system and an angular adjustment, which at least partly overcomes the hereinafore-mentioned disadvantages of the heretofore-known devices of this general type and which allows easy mounting and adjustment of a tool sleeve.

With the foregoing and other objects in view there is provided, in accordance with the invention, a rotary embossing device for embossing flat or planar materials such as sheets, blanks and webs of paper, cardboard, plastics and composite materials. The rotary embossing device of the invention comprises a drive shaft and an embossing tool disposed thereon, the embossing tool including a roller body, a mounting system, and a tool sleeve, which is mounted to the roller body by the mounting system. A rotary counter-tool may be mounted to a parallel further drive shaft. In order to process the planar material, the material is transported between the two tools. In accordance with the invention, the mounting system includes at least one mounting ring disposed between the roller body and the roller sleeve and used to mount the tool sleeve. In contrast to the mounting systems of the prior art, the mounting ring has a low mass moment of inertia. Advantageously, the at least one mounting ring is in engagement with an adjustment device for rotating the at least one mounting ring to adjust the angular position of the tool sleeve about an axis of rotation of the embossing tool. Thus, the tool sleeve is likewise rotated relative to the drive shaft. The rotation is attained by a displacement of the mounting ring along the roller body surface, which is preferably cylindrical. This feature provides adjustability of the angular position of the mounting ring and thus of the tool sleeve relative to the drive shaft and thus relative to a counter-tool that may potentially be provided. If multiple embossing tools are provided on one and the same drive shaft, it is possible for the tool sleeves of the embossing tools to experience different angular adjustments and thus to be adjusted relative to each other.

In accordance with another particularly advantageous and thus preferred development of the rotary embossing device of the invention, the adjustment device in particular includes a positioning element that is movable in particular in an axial direction and is assigned an adjustment mechanism in particular disposed inside the roller body, and a groove is formed on the interior surface of the mounting ring, the positioning element being displaceable in the groove, with a displacement causing an adjustment of the mounting ring. The groove in the mounting ring is in particular aligned at an acute angle relative to the axial direction. The adjustment mechanism is easily accessible from outside the embossing tool, easily allowing the operator to adjust the mounting ring by actuating the adjustment mechanism. A further advantage is that the adjustment device has a very compact construction and has only a low moment of inertia.

In accordance with a further alternative embodiment of the rotary embossing device of the invention, the adjustment device includes a cam disc that is supported in the roller body and the rotation of which causes the mounting ring to be adjusted.

In accordance with an added alternative embodiment of the invention, the adjustment device includes a worm gear/spur gear system and the interior surface of the mounting ring has a toothing. A rotation of the worm gear is transmitted to the mounting ring by the spur gear and the toothing causes the mounting ring to be adjusted.

With the objects of the invention in view, there is also provided a rotary embossing device, in particular a rotary embossing device constructed in accordance with the above description. In accordance with the invention, the mounting system includes a mounting ring disposed between the tool body and the tool sleeve to mount the tool sleeve. The mounting ring advantageously includes at least one elastomeric ring and the mounting system further includes a mounting cover that is axially movable to compress the at least one elastomeric ring. When the at least one elastomeric ring is compressed by the mounting cover, the at least one elastomeric ring expands in the radial direction, resulting in a mounting of the tool sleeve. This construction of the rotary embossing tool advantageously provides easy mounting of the tool sleeve, in that the tool sleeve may firstly be slid onto the mounting ring and then the tool sleeve is mounted by a rotation of the mounting cover and is thus fixed to the roller body.

In accordance with another particularly advantageous and thus preferred development of the rotary device of the invention the mounting ring includes a plurality of elastomeric rings and in particular a respective stiff spacer ring between each two elastomeric rings. This allows the mounting force of the mounting system to be particularly evenly distributed and to act onto a large area of the tool sleeve to hold the tool sleeve in a particularly secure way.

In accordance with a further advantageous development at least one end of the roller body has an exterior threading and the mounting cover has a complementary interior threading to screw the mounting cover onto the roller body, fixing the mounting ring on the roller body. At the same time, screwing on the mounting cover causes the mounting cover to be axially displaced and the elastomeric ring to be compressed.

In accordance with an added feature of the invention, the elastomeric material may in particular be acrylonitrile butadiene rubber.

In accordance with a first embodiment, the tool sleeve is tubular and has a continuous circumferential surface. In accordance with an alternative second embodiment, the tool sleeve is likewise tubular, but has a slotted circumferential surface. In the second case, in accordance with a particularly advantageous embodiment, the mounting ring includes a connecting piece and the two longitudinal edges of the tool sleeve are connectable to the connecting piece, in particular in a form-locking way. The elastomeric rings and spacer rings may be fixed to the connecting piece. The groove of the adjustment device may likewise be disposed in the connecting piece. A form-locking connection is one which connects two elements together due to the shape of the elements themselves, as opposed to a force-locking connection, which locks the elements together by force external to the elements.

In accordance with a concomitant feature of the invention, the tool may advantageously be used in a Braille embossing device in a folder-gluer.

Other features which are considered as characteristic for the invention are set forth in the appended claims, noting that any combination of the described invention and the described advantageous further developments of the invention also form an advantageous further development of the invention. Further advantages and embodiments that are advantageous in structural and functional terms are set forth in the dependent claims and the description of exemplary embodiments with reference to the appended figures.

Although the invention is illustrated and described herein as embodied in a rotary embossing device with a mounting system and an angular adjustment, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which corresponding elements and components are indicated by identical reference symbols and in which, for reasons of clarity, the figures are not drawn to scale.

DETAILED DESCRIPTION OF THE INVENTION

Figure 1:
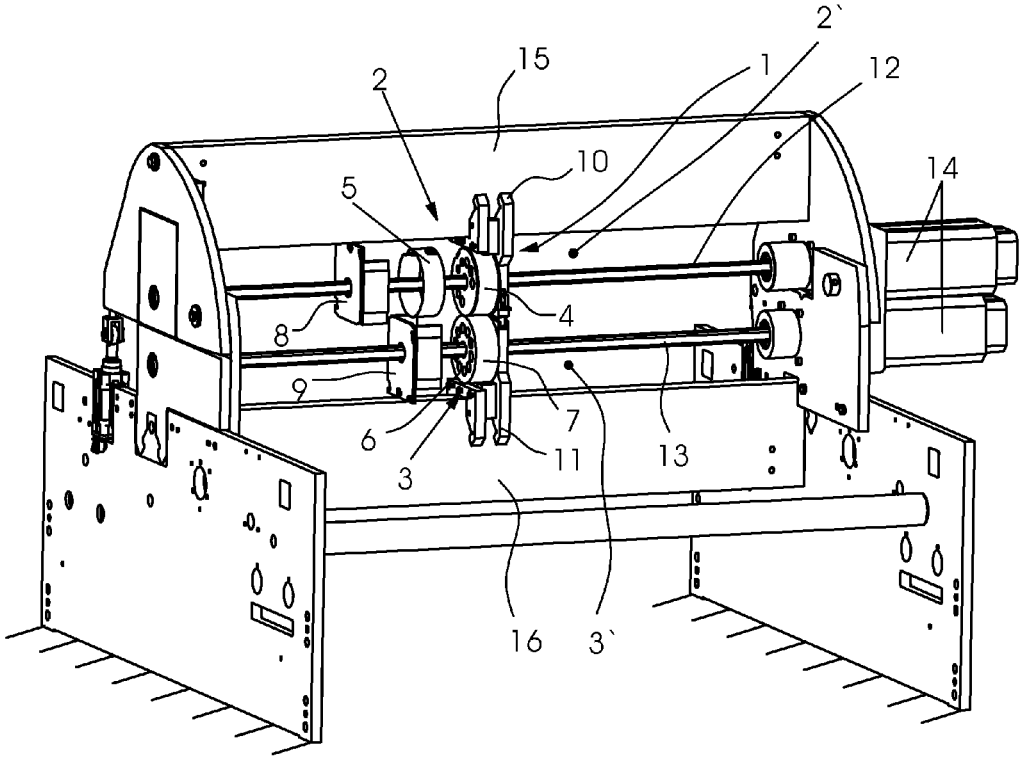
FIG. 1 is a diagrammatic, perspective view of an embossing apparatus including an embossing device of the invention.

Referring now to the figures of the drawings in detail and first, particularly, to FIG. 1 thereof, there is seen an embossing apparatus that includes a rotary embossing device 1 constructed in accordance with the invention and shown in a partially disassembled condition. The rotary embossing device 1 includes an upper tool embodied as a male tool 2 and a lower tool embodied as a female tool 3. The male tool 2 is formed of a roller body 4 to which a tool sleeve 5 is fixed. The tool sleeve 5 has raised embossing dots on its circumferential surface. For reasons of visibility, the raised dots are not shown in FIG. 1. The female tool 3 likewise includes a roller body 6, having an outer circumferential surface 7 with corresponding depressions (which are likewise not shown in FIG. 1 for reasons of clarity). The depressions may be formed either directly in the outer circumferential surface 7 of the roller body 6 of the female tool 3 or, in a manner analogous to the male tool, in a tool sleeve, which is not shown in any detail herein and which is fixed to the roller body 6 of the female tool 3. Both the male tool 2 and the female tool 3 are protected against contact by protective boxes 8, 9. The male tool 2 is supported on a (non-illustrated) flange and is driven by a drive shaft 12. Furthermore, the male tool 2 is laterally guided by an upper tool-guiding element 10 that is supported on a crossbar 15. The female tool 3 is supported on a (non-illustrated) flange and is driven by a lower drive shaft 13. Furthermore, the female tool 3 is laterally guided by a lower tool-guiding element 11 that is supported on a lower crossbar 16. Further rotary tools may be provided on the drive shafts 12, 13 in parallel with the illustrated rotary tools 2, 3. A position of a further male tool 2' is indicated by a first dot and a position of a further female tool 3' is indicated by a second dot. The drive shafts 12, 13 are driven by servomotors 14. An embossing device of this kind allows sheet-shaped, blank-shaped, or web-shaped printing substrates to be provided with an embossment, in particular a Braille embossment, by passing the printing substrates between the male tool 2 and the female tool 3 using a commonly known and thus non-illustrated belt transport system.

Figure 2:
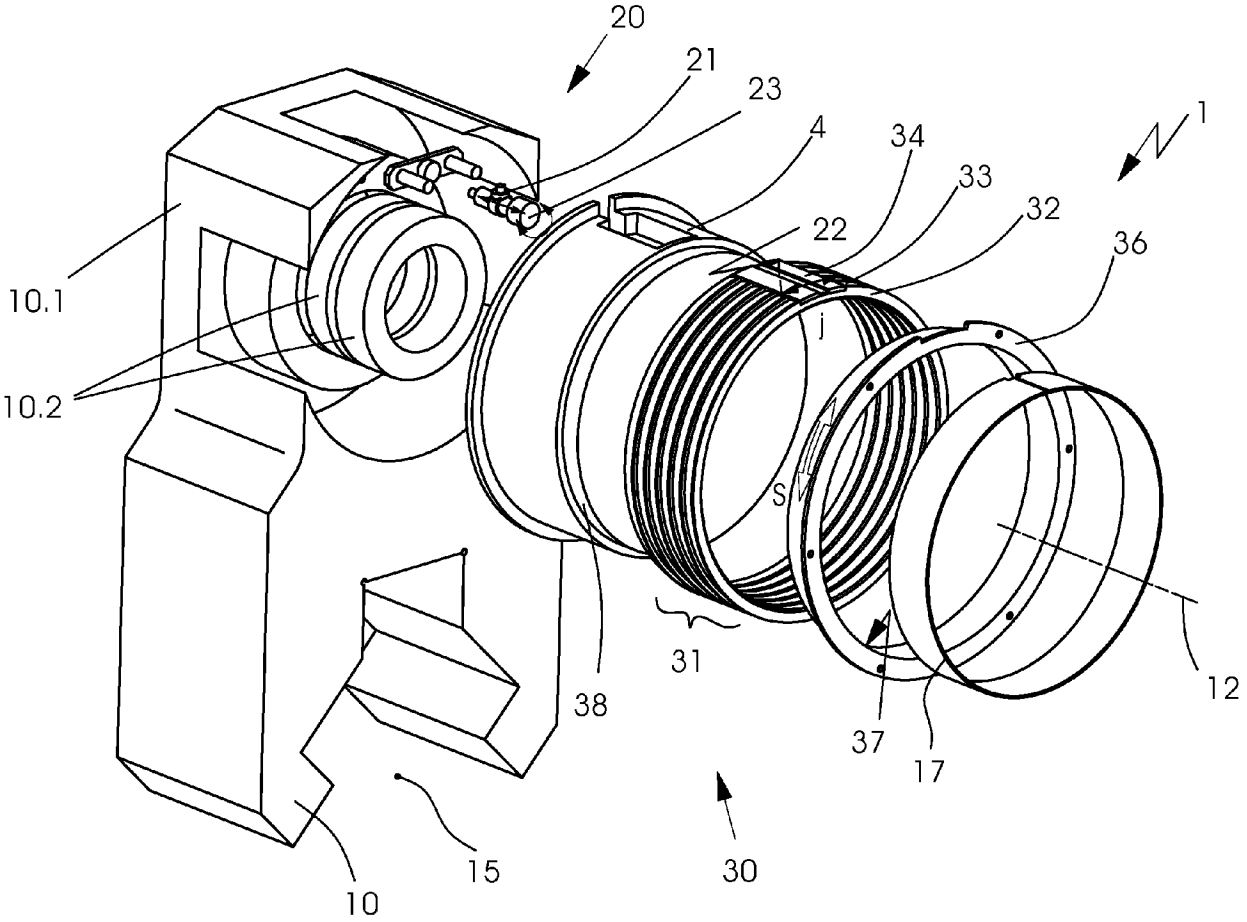
FIG. 2 is an exploded, perspective view of the embossing device.

FIG. 2 illustrates a rotary embossing device 1 of the invention that may be slid onto a diagrammatically-illustrated drive shaft 12 and may be fixed to a diagrammatically-illustrated crossbar 15 by using a tool-guiding element 10. A roller body 4 is supported on ball bearings 10.2 of a tool carrier 10.1 and has an internal polygon that has a complementary construction relative to an exterior polygon of the drive shaft 12. Polygonal shafts or a shaft and a fitting key may be used instead of a polygon, in which case the roller body likewise has a complementary construction. Thus, the roller body 4 is supported on the tool carrier 10.1 and is driven by the drive shaft 12. A mounting ring 31 is slid onto the roller body 4. The mounting ring 31 is formed of a plurality of elastomeric rings 32. A respective spacer ring 33 is disposed between every two elastomeric rings 32. Both the elastomeric rings 32 and the spacer rings 33 are fixed to a connecting piece 34 and are held together in this way. One end of the roller body 4 is provided with an exterior threading 38, onto which a mounting cover 36 provided with an interior threading 37 may be screwed. Engagement locations for a tool may be provided in the mounting cover 36 to allow the mounting cover 36 to be easily rotated. These engagement locations may be bores for a face pin spanner wrench. When the mounting cover 36 is screwed on, the mounting ring 31 is secured.

This device is used to receive job-dependent tool sleeves 17 having different structures which may, for instance, be provided with raised portions to create Braille dots. In the illustrated case, the tool sleeve is a slotted tool sleeve 17. This tool sleeve 17 may be slid onto the mounting ring 31 without difficulty. The longitudinal edges of the tool sleeve 17 in the region of its slot engage in specifically formed grooves of the connecting piece 34, causing the tool sleeve 17 to be fixed on the mounting ring 31. In order to ensure a secure fit of the tool sleeve 17, tension needs to be created in the mounting system 30. This is done by screwing the mounting cover 36 further onto the roller body 4. This screwing movement causes the elastomeric rings 32 to be compressed or squeezed and to expand in a radial direction. Due to the expansion of the elastomeric rings 32, the tool sleeve 17 is mounted and is securely pressure-fitted onto the roller body 4. A screwing movement s for mounting purposes is indicated by a double-headed arrow in FIG. 2.

If an angular adjustment of the tool sleeve 17 needs to be made relative to a non-illustrated counter-tool or relative to a (non-illustrated) further rotary embossing tool 2 mounted to the shaft 12, the angular adjustment may easily be achieved by actuating the adjustment device 20. For this purpose, the adjustment device 20 includes a positioning element 21, which is pin-shaped and may be actuated by an adjustment mechanism 23. The adjustment mechanism 23 includes a threaded pin that has a hexagonal socket, for example, which is easily accessible from outside of the male tool 2. Actuation of the hexagonal socket causes the headless screw to be rotated. The positioning element 21 has a matching interior threading and is displaced in an axial direction by the rotation. The adjustment mechanism 23 is integrated in the roller body 4. Only a pin of the positioning element 21 protrudes from the offset circumferential surface of the roller body 4. This pin of the positioning element 21 engages in a groove 22 formed on the interior side of the connecting element 34. A groove 22 (indicated by a dashed line in FIG. 2) is oriented in the connecting element 34 in such a way that it is aligned at an acute angle relative to the axial direction. Thus, an axial displacement of the positioning element 21 due to an actuation of the adjustment mechanism 23 results in an angular adjustment of the connecting element 34 and thus of the entire mounting ring 31 together with the entire tool sleeve 17. In order to illustrate this aspect, the orientation of the groove 22 is indicated by a dashed line in FIG. 2. A resultant adjustment movement j in the circumferential direction of the tool sleeve 17 to correct the angular position of the tool sleeve 17 is indicated by an arrow.

Figure 3:
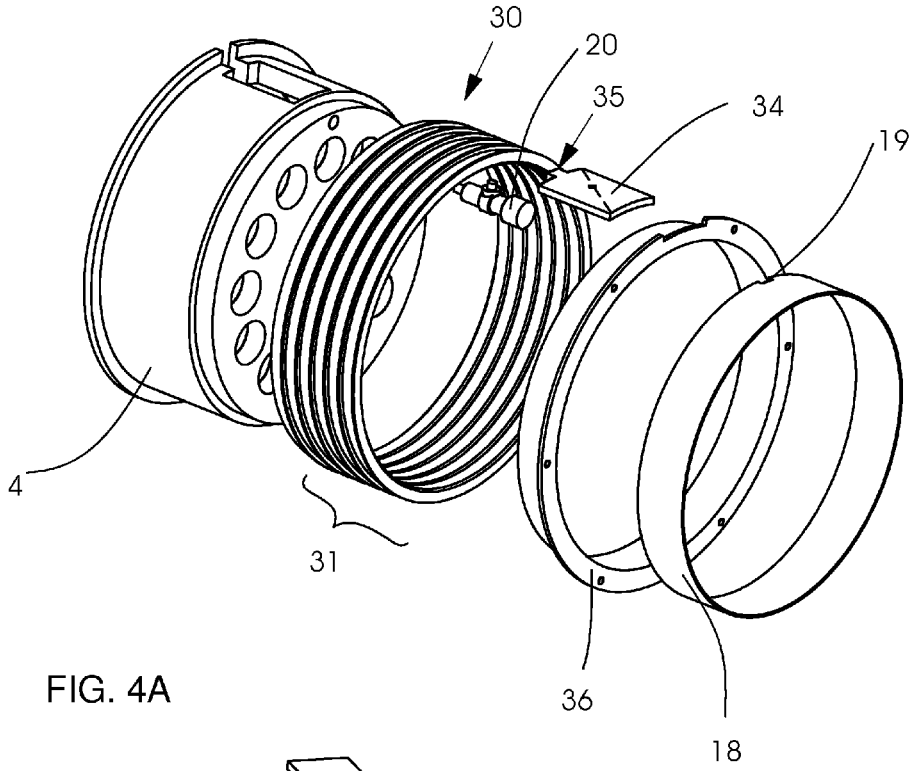
FIG. 3 is an exploded, perspective view of an alternative embodiment of the embossing device.

FIG. 3 illustrates an alternative embodiment of the rotary embossing device 1 for using continuous tool sleeves 18. The continuous tool sleeve 18 has a recess 19 on its circular edges. The connecting piece 34, which is connected to the mounting ring 31 and inserted between the roller body 4 and the mounting ring 31, has a protrusion 35 that is complementary to the recess 19. When the tool sleeve 18 is slid onto the mounting ring 31, the recess 19 engages in the protrusion 35 so that the continuous tool sleeve 18 is fixed to the tensioning ring 31. The mounting of the tool sleeve 18 is achieved in the way described above, i.e. by a further screwing-on(s) of the mounting cover 36. The angular adjustment of the tool sleeve 18 may likewise be achieved with the aid of an adjustment device 20 as described above, which causes the connecting piece 34, the mounting ring 31 and thus the tool sleeve 18 to rotate in a circumferential direction by using a groove (indicated by a dashed line).

Figure 4A:
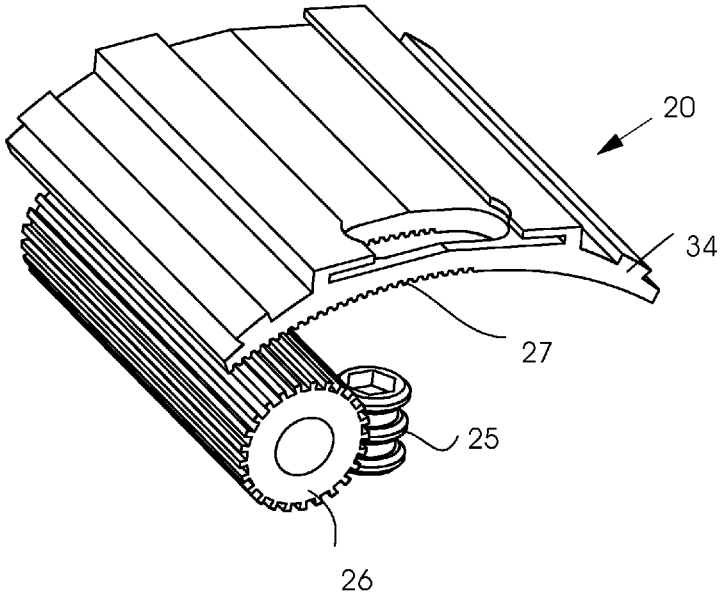
FIGS. 4A and 4B are perspective views of two alternative embodiments of an angle adjustment device.

FIG. 4A illustrates a first alternative embodiment of the adjustment device 20. The adjustment device 20 has a worm gear/spur gear system 25, 26. The worm gear 25 is provided with a hexagonal socket, which is easily accessible from outside through a bore in the connecting piece 34. The worm gear 25 engages in a spur gear 26 that is provided with an exterior toothing. The exterior toothing of the spur gear 26 in turn engages in a toothing 27 on the inside of the connecting piece 34. The interaction between the worm gear 25 and the spur gear 26 results in a very high degree of gear reduction and thus in a very accurate adjustment of the position of the connecting piece 34 relative to the roller body 4.

Figure 4B:
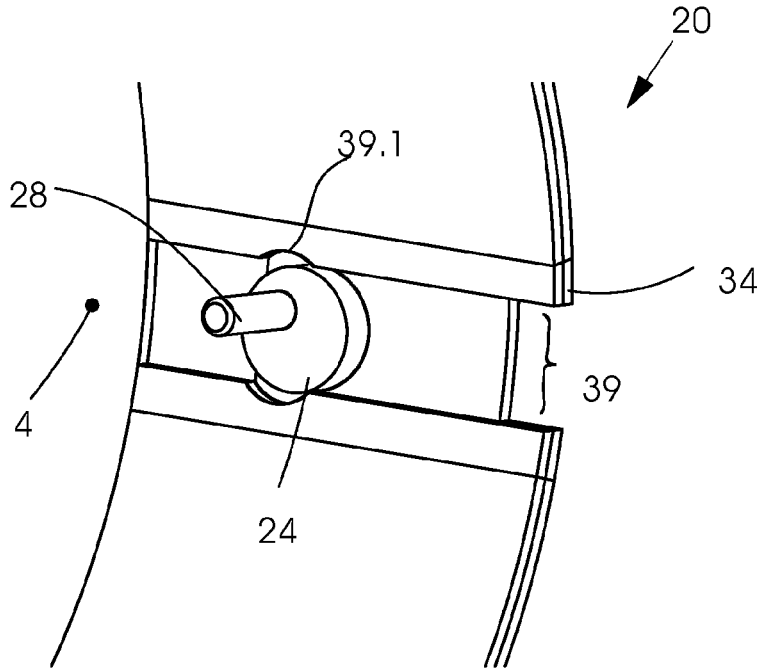

FIG. 4B illustrates a further alternative embodiment of the adjustment device 20 including a cam 24. The cam 24 is inserted in the roller body 4 and is supported for rotation by a journal 28 that engages in a bore in the roller body 4. The cam 24 has a hexagonal socket on its surface which is not visible in FIG. 4B, for initiating a rotary movement of the cam disc 24 from outside the rotary embossing device 1. The cam disc 24 is located in the region of a connecting piece 34. For this purpose, the connecting piece 34 has a groove 39 on its interior side for receiving the cam disc 24. A longitudinal bore 39.1, which is only visible in outline in FIG. 4B, is formed in the region of the groove 39 in the connecting piece 34. The longitudinal bore 39.1 ensures that the (non-illustrated) hexagonal socket of the cam disc 24 remains accessible to the operator of the machine. Rotation of the cam disc 24 causes the connecting piece 34 to be displaced relative to the roller body 4 through the groove 39, resulting in an angular adjustment of the mounting ring 31 and thus of a tool sleeve 17, 18.

The invention claimed is:

1. A rotary embossing device for embossing flat materials including sheets, blanks, webs of paper, cardboard, plastics and composite materials, the rotary embossing device comprising:

a drive shaft;

at least one embossing tool disposed on said drive shaft and having an axis of rotation, said at least one embossing tool including a roller body, a tool sleeve and a mounting system configured to mount said tool sleeve to said roller body;

said mounting system having at least one mounting ring disposed between said roller body and said tool sleeve, said at least one mounting ring having an interior surface with a groove; and an adjustment device configured to engage said at least one mounting ring and rotate said at least one mounting ring for an angular adjustment of said tool sleeve about said axis of rotation of said at least one embossing tool, said adjustment device including a positioning element and an adjustment mechanism associated with said positioning element, and said positioning element being displaceable in said groove with a displacement causing said at least one mounting ring to be adjusted.

2. The rotary embossing device according to claim 1, wherein said positioning element is axially displaceable and said adjustment mechanism is disposed inside said roller body.

3. A rotary embossing device for embossing flat materials including sheets, blanks, webs of paper, cardboard, plastics and composite materials, the rotary embossing device comprising:

a drive shaft;

at least one embossing tool disposed on said drive shaft and having an axis of rotation, said at least one embossing tool including a roller body, a tool sleeve and a mounting system configured to mount said tool sleeve to said roller body;

said mounting system having at least one mounting ring disposed between said roller body and said tool sleeve; and an adjustment device configured to engage said at least one mounting ring and rotate said at least one mounting ring for an angular adjustment of said tool sleeve about said axis of rotation of said at least one embossing tool;

said adjustment device having a cam disc supported in said roller body, and said cam disc being configured to rotate to cause said at least one mounting ring to be adjusted.

4. A rotary embossing device for embossing flat materials including sheets, blanks, webs of paper, cardboard, plastics and composite materials, the rotary embossing device comprising:

a drive shaft;

at least one embossing tool disposed on said drive shaft and having an axis of rotation, said at least one embossing tool including a roller body, a tool sleeve and a mounting system configured to mount said tool sleeve to said roller body;

said mounting system having at least one mounting ring disposed between said roller body and said tool sleeve, said at least one mounting ring having an interior surface with a toothing; and an adjustment device configured to engage said at least one mounting ring and rotate said at least one mounting ring for an angular adjustment of said tool sleeve about said axis of rotation of said at least one embossing tool;

said adjustment device including a system having a worm gear and a spur gear, and said worm gear being configured to rotate to cause said at least one mounting ring to be adjusted through said spur gear and said toothing.

5. A rotary embossing device for embossing flat materials including sheets, blanks, webs of paper, cardboard, plastics and composite materials, the rotary embossing device comprising:

a drive shaft;

at least one embossing tool disposed on said drive shaft and having an axis of rotation, said at least one embossing tool including a roller body, a tool sleeve and a mounting system configured to mount said tool sleeve to said roller body, said tool sleeve being tubular and having a continuous circumferential surface;

said mounting system having at least one mounting ring disposed between said roller body and said tool sleeve; and an adjustment device configured to engage said at least one mounting ring and rotate said at least one mounting ring for an angular adjustment of said tool sleeve about said axis of rotation of said at least one embossing tool.

6. A rotary embossing device for embossing flat materials including sheets, blanks, webs of paper, cardboard, plastics and composite materials, the rotary embossing device comprising:

a drive shaft;

at least one embossing tool disposed on said drive shaft and having an axis of rotation, said at least one embossing tool including a roller body, a tool sleeve and a mounting system configured to mount said tool sleeve to said roller body, said tool sleeve having a tubular shape and a slotted circumferential surface;

said mounting system having at least one mounting ring disposed between said roller body and said tool sleeve, said at least one mounting ring including a connecting piece; and an adjustment device configured to engage said at least one mounting ring and rotate said at least one mounting ring for an angular adjustment of said tool sleeve about said axis of rotation of said at least one embossing tool;

said tool sleeve having two longitudinal edges connected to said connecting piece.

7. The rotary embossing device according to claim 6, wherein said longitudinal edges of said tool sleeve are form-lockingly connected to said connecting piece.

8. A rotary embossing device for embossing flat materials including sheets, blanks, webs of paper, cardboard, plastics and composite materials, the rotary embossing device comprising:

a drive shaft;

an embossing tool disposed on said drive shaft, said embossing tool having a roller body, a tool sleeve and a mounting system configured to mount said tool sleeve to said roller body;

said tool sleeve having a tubular shape and a slotted circumferential surface;

said mounting system including at least one mounting ring disposed between said roller body and said tool sleeve;

said at least one mounting ring including at least one elastomeric ring and a connecting piece;

said mounting system including an axially displaceable mounting cover configured to compress said at least one elastomeric ring; and said tool sleeve having two longitudinal edges connected to said connecting piece.

9. The rotary embossing device according to claim 8, wherein said at least one elastomeric ring of said at least one mounting ring is a plurality of elastomeric rings, and spacer rings are each disposed between a respective two of said elastomeric rings.

10. The rotary embossing device according to claim 9, wherein said spacer rings are stiff spacer rings.

11. The rotary embossing device according to claim 8, wherein said roller body has an exterior thread and said mounting cover has an interior thread complementary to said exterior thread for screwing said mounting cover onto said roller body.

12. The rotary embossing device according to claim 8, wherein said at least one elastomeric ring is formed of an acrylonitrile butadiene rubber elastomeric material.

13. The rotary embossing device according to claim 8, wherein said longitudinal edges of said tool sleeve are form-lockingly connected to said connecting piece.

* * * * *